United States Patent [19]

Marton

[11] Patent Number: 4,558,542

[45] Date of Patent: Dec. 17, 1985

[54] STICK-ON ABRASIVE DISC

[76] Inventor: Miska Marton, 3620 Rankin Blvd., Windsor, Ontario, Canada

[21] Appl. No.: 219,489

[22] Filed: Dec. 23, 1980

Related U.S. Application Data

[63] Continuation-in-part of Ser. No. 142,780, Apr. 22, 1980, abandoned, which is a continuation of Ser. No. 934,991, Aug. 18, 1978, abandoned, which is a continuation-in-part of Ser. No. 893,602, Apr. 3, 1978, abandoned.

[30] Foreign Application Priority Data

May 5, 1978 [CA] Canada ..... 302741

[51] Int. Cl.[4] ..... B24D 9/08; B24D 11/02

[52] U.S. Cl. ..... 51/358; 51/401; 51/407

[58] Field of Search ..... 51/297, 358, 394, 401, 51/404, 406, 407, 379, 376, DIG. 34

[56] References Cited

U.S. PATENT DOCUMENTS

| | | | |
|---|---|---|---|
| Re. 20,946 | 12/1938 | Carlton | 51/404 |
| 2,186,001 | 1/1940 | Bartling | 51/298 |
| 2,279,673 | 4/1942 | Graenser | 51/379 |
| 2,286,208 | 6/1942 | Kirchner | 51/406 |
| 2,349,365 | 5/1944 | Martin | 51/404 |
| 2,667,436 | 1/1954 | Geopfert | 51/297 |
| 2,878,142 | 3/1959 | Bohaty | 51/297 |
| 2,958,166 | 11/1960 | Foland | 51/358 |
| 3,136,614 | 6/1964 | Kuzmich | 51/298 |
| 3,186,135 | 6/1965 | Cream | 51/394 |
| 3,227,604 | 1/1966 | Morgan | 428/40 |
| 3,267,623 | 8/1966 | Block | 51/406 |
| 3,413,106 | 11/1968 | Argiro | 51/295 |
| 3,510,992 | 5/1970 | Hutchins | 51/378 |
| 3,520,090 | 7/1970 | Lee | 51/170 |
| 3,522,681 | 8/1970 | Lampert | 51/358 |
| 3,707,059 | 12/1972 | Burtch | 51/358 |
| 3,849,949 | 11/1974 | Stenhauser | 51/406 |
| 3,875,703 | 4/1975 | Clemente | 51/406 X |
| 3,892,091 | 7/1975 | Hutchins | 51/358 X |

FOREIGN PATENT DOCUMENTS

| | | |
|---|---|---|
| 871436 | 5/1971 | Canada . |
| 890678 | 1/1972 | Canada . |
| 995124 | 8/1976 | Canada . |
| 1676268 | 10/1953 | Fed. Rep. of Germany . |
| 2023811 | 11/1970 | Fed. Rep. of Germany . |
| 2301334 | 9/1976 | France . |
| 316308 | 9/1930 | United Kingdom . |
| 425356 | 3/1935 | United Kingdom . |
| 556147 | 9/1943 | United Kingdom . |
| 971741 | 10/1964 | United Kingdom . |
| 1103240 | 2/1968 | United Kingdom . |
| 1148350 | 4/1969 | United Kingdom . |
| 1175420 | 12/1969 | United Kingdom . |
| 1377943 | 12/1974 | United Kingdom . |
| 1384293 | 2/1975 | United Kingdom . |

*Primary Examiner*—Robert P. Olszewski

*Attorney, Agent, or Firm*—Cushman, Darby & Cushman

[57] ABSTRACT

An abrasive or sanding disc for use on a rotary or double action backup pad is provided on its rear surface with a smooth flexible coating to give strength to the sandpaper and to stick to a feathering adhesive on a backup pad. The smooth coating is typically a nylon coating or an adhesive which bonds to the back of the sandpaper and acts as a coating; this coating also adheres strongly to a feathering adhesive on a backup pad. The sanding disc can be strongly secured to the backup pad but can be pulled away from it, leaving the feathering adhesive on the backup pad.

3 Claims, 2 Drawing Figures

STICK-ON ABRASIVE DISC

CROSS REFERENCE TO RELATED APPLICATIONS

This application is a continuation-in-part of my earlier application Ser. No. 142,780 filed Apr. 22, 1980, now abandoned which in turn is a continuation of my earlier application Ser. No. 934,991 filed Aug. 18, 1978, now abandoned, which, in turn, is a continuatin-in-part of my earlier application Ser. No. 893,602 filed Apr. 3, 1978 and now abandoned.

BACKGROUND OF THE INVENTION

This invention relates to abrasive discs for rotary sanders or double action sanding machines and in particularly to a system for removably securing the abrasive discs to the backup pad of such machines.

Conventionally, abrasive sheets or sanding discs are bonded by adhesive, known in the trade as a feathering adhesive, to backup pads or backup plates of sanding machines and while this method has been in use for sometime it has a number of drawbacks. For one, the operator has to apply the adhesive or glue both to the disc and to the backup pad. In many cases, the operator applies the glue to the paper and rubs both the disc and the backup pad together so as to spread the adhesive evenly on the paper. However, in many cases the glue or adhesive gets onto the abrasive side of the disc and subsequently gets onto the paint surface of sheet metal which is being sanded. It also plugs up the sanding disc. Moreover, the sandpaper in many cases tears up in use and when the operator tries to remove the sandpaper from the backup pad it pulls away in small pieces or chunks.

It is often impossible for the operator to remove the sanding disc completely from the backup pad because of the chunks or pieces of paper left adhered to the backup pad from the previous disc. The operator then has no other choice but to apply more glue on top of the old sanding disc pieces and this causes high spots on the backup pad and presents an uneven and unbalanced operative surface. It will be appreciated that when the operator applies the second or new sandpaper disc on the high spots alone, the rest of the disc does not even touch the sanded surface. This leads to the high spots creating plugging up of the sandpaper which in turn leaves marks on the surface being sanded. Additionally, this can result in ripped sandpaper discs and if the operator does not immediately catch it, the existing glue on the backup pad will stick to the paint on the surface being sanded which in turn has to be resanded and repainted again.

The above-mentioned problems are compounded when an operator is using a fine sandpaper disc as the finer papers are the most critical to be used with a glue-on system. The finer papers bond so strongly to the backup pad that the paper tears when it is being removed therefrom. Furthermore, the fine paper tears very easily when it is in use and then the feathering adhesive on the backup pad is rubbed into the paint of the surface being sanded and the glue stays on the sanded surface, the backup pad becoming dirty and dusty from the paint. In a situation of this sort, the operator then has great difficulty in removing the ripped sandpaper from the backup pad because the backup pad is dirty and there are chunks of ripped and split sandpaper. The operator is then normally forced to apply more adhesive to the backup pad to make the next disc stick and if the paper is strong enough to be peeled away from the pad, the paper takes a lot of the feathering adhesive from the backup pad.

In another example of conventional glue-on systems, the manufacturer of the sanding disc applies glue to the sanding disc so that the operator does not have to do it. However, the problem remains exactly as defined above. The paper tears, the pad gets dirty and more glue must be applied to the backup pad.

In another example of the prior art, a manufacturer applied glue to the sanding disc and then applies a wax paper over the glue. The operator has to remove the wax paper but this method does not change any of the above-mentioned problems which appears subsequent to putting the paper on to the backup pad. Wax paper is added to the back of the sanding disc only so that the glue will not dry out and that one disc will not stick to another.

One of the main problems therefore with previously available glue-on or stick-on discs is the removal of the discs from the backup pad when the disc is worn out. Even using strong rosin paper, it has been found that it is almost impossible to remove the disc cleanly from the backup pad and in some cases operators have had to heat the papers in an attempt to soften the adhesive to completely remove the disc.

SUMMARY OF THE INVENTION

The present invention overcomes the above-mentioned difficulties in the prior art by providing a system including a sanding disc with a coating thereon which does not in itself require adhesive but which would adhere to the adhesive on the backup pad. With a disc of this type, the operator does not have to use any glue on the disc or paper itself and applies fastening adhesive only to the backup pad.

In accordance with the conventional practice mentioned above, feathering adhesive has to be applied both to the paper and to the backup pad to achieve strong bonding. In most cases, the papers were weak, they ripped up when used or when removed from the pad. In accordance with the present invention the above-mentioned problems of the prior art are prevented and an operator may use up to 80% less feathering adhesive than in conventional practice.

The coating of the abrasive sheet in accordance with the present invention provides a smooth flexible finish that requires no further glue or adhesive on the back of the sheet; it sticks to the feathering adhesive on the backup pad and peels away therefrom without taking any feathering adhesive with it. The life of the abrasive sheet is increased substantially and the system prevents glue from getting on the sanded surface.

With the present invention, the use of glue can be completely eliminated from the sanding disc through the use of a very thin and very strong nylon type of material. This material can be nylon or any other suitable type of plastic material but is very flexible and very strong. This is bonded permanently to the back of the thin sandpaper, making the thin sandpaper strong but leaving it very flexible. It gives the operator a perfectly smooth coating on the back of the sanding disc to stick the disc to the feathering adhesive on the backup pad. Most important, it allows the operator to peel the thin sandpaper away from the backup pad without taking the feathering adhesive with it.

A typical feathering adhesive used in automotive refinishing and industrial sanding for holding abrasive discs to any backup pad is No. 10 Disc Adhesive available from Norton Company of Worcester, Mass.

According to the broadest aspect, the invention relates to an abrasive sheet for application to a backup pad of a sanding machine, the sheet including an abrasive bonded to the front surface of the sheet and a smooth flexible coating bonded to the rear surface of the sheet whereby the sheet can be removably secured to an adhesive surface on a backup pad.

In accordance with a broad aspect, the invention relates to an abrasive sheet for application to a backup pad of a sanding machine, said backup pad having feathering adhesive thereon, the abrasive sheet consisting essentially of an abrasive bonded to the front or face thereof and a smooth, continuous, flexible plastics coating bonded permanently to the rear surface thereof, the sheet being removably secured to the feathering adhesive surface on the backup pad for removal therefrom without removing the feathering adhesive which is the sole adhesive for removably securing the abrasive sheet to the backup pad.

In accordance with another broad aspect, the invention relates to an abrasive sheet for applying to a backup pad of a sanding machine, said backup pad having feathering adhesive thereon, the abrasive sheet consisting of an abrasive bonded to the front surface thereof and a smooth, adhesive sensitive, flexible plastics coating permanently bonded to the rear surface thereof, the sheet adapted to be removably secured to the feathering adhesive surface on the backup pad for removal therefrom without removing the feathering adhesive.

In accordance with a further broad aspect, the invention relates to a method of manufacturing an abrasive sheet material for application to a backup pad of a sanding machine, in which said abrasive sheet consists essentially of an abrasive bonded to the front face thereof and having a rear surface, said method comprising applying a smooth, continuous, flexible plastics coating to the rear surface of said abrasive sheet material and permanently bonding the coating thereto, the thus coated sheet adapted to be removably secured to said backup with a feathering adhesive and removable therefrom removing the feathering adhesive from the backup pad.

BRIEF DESCRIPTION OF THE DRAWINGS

The invention is illustrated by way of example in the accompanying drawings in which.

DETAILED DESCRIPTION OF THE INVENTION

Figure 1:
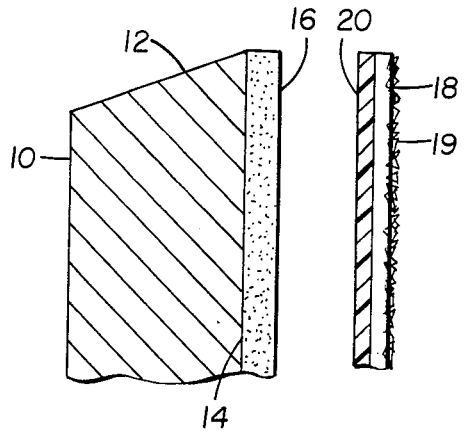
FIG. 1 is a fragmented, sectional view of the backup pad and an abrasive sheet in accordance with the invention.
Figure 2:
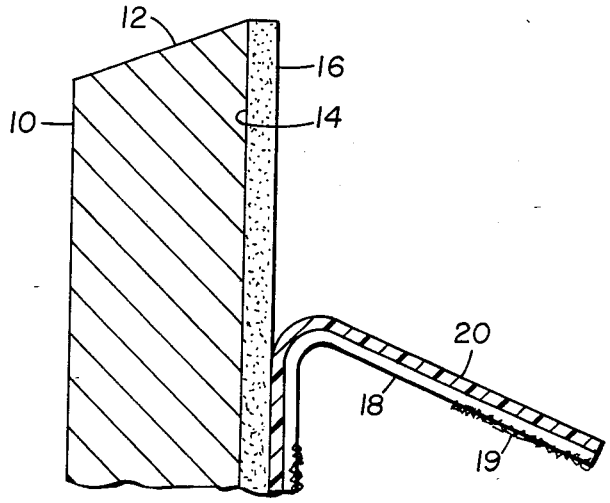
FIG. 2 illustrates the manner of removal of the abrasive disc from the backup pad.

Referring to FIG. 1, a backup pad 10 of the type for example which is used in a rotary or double action sanding device includes a soft flexible member 12 and the front face 14 thereof is provided with a feathering adhesive 16. The abrasive sheet is preferably in the form of circular disc 18 having an abrasive surface 19. Disc 18 is adapted to be adhered to the adhesive 16 on the face 14 of the backup pad 10 to effect a sanding operation. When the abrasive surface 19 of the sheet 18 is worn away, then the sheet 18 is removed from the backup pad 10, discarded and replaced with a new one.

In accordance with the arrangement of FIG. 1, the abrasive sheet 18 is provided with a smooth flexible coating 20 of nylon, any other suitable plastics material or of an ethylene-polyvinyl acetate copolymer, which coating can be applied by brush, roller or spray. The coating 20 bonds permanently to the back of the sanding sheet 18 and provides the sheet with extra strength, particularly if the disc is thin. The coating 20 also provides the side of the abrasive sheet 18, in contact with the feathering adhesive, with a smooth, adhesive-sensitive surface and flexible coating permanently bonded to the rear surface. Essentially the coating 20 also releases the feathering adhesive from itself and also sticks extremely well to the feathering adhesive when the sanding device is being used.

A preferred material for forming the smooth, flexible coating is an emulsion of ethylene-vinyl acetate copolymer. One suitable product is PR 1079L available from Canada Glue Company of Brantford, Ontario. The material is characterized by the following properties:

Viscosity: 50–100 mPa's at 25° C.
Solids Content: 44–46%
pH: 4.5–5.5
weight per liter: 1.1 kg/L
provides a clear flexible film.

It will be appreciated that the sanding disc 18 of this invention can be peeled away from the feathering adhesive 16 of the backup pad, leaving the feathering adhesive on the backup pad. The coating also provides additional strength to the sanding disc and the operator never has to add feathering adhesive to the back of the coated sanding disc itself.

In conventional methods, feathering adhesive had to be applied to the sanding sheet as well as to the backup pad to obtain sufficiently strong bonding for use.

While I am using the above-mentioned coating of an ethylene-polyvinyl acetate copolymer at the present time, it will be appreciated that other types of coatings such as nylon can be used to provide the same or substantially the same result.

The use of the sanding disc according to the present invention solves the problems of the conventional, glue-on type of operation. The provision of a smooth, flexible coating to the back of the sanding disc 18;

(a) gives strength to thin or fine sandpaper so that it does not tear when it is used;
(b) no matter how much glue an operator applies to a backup pad, the operator can peel the sanding disc away from the backup pad without leaving any chunks of sanding disc which otherwise would make the backup surface uneven;
(c) the operator does not have to worry about how long the sandpaper is left on the backup pad as it can be peeled off at any time, keeping the feathering adhesive from drying out or getting dirty;
(d) an operator can use up to 80% less feathering adhesive according to the present invention;
(e) the life of the sanding disc is lengthened because it is worn out before it will tear;
(f) because the paper will not tear when it is in use it will not leave any feathering adhesive on the sanded surface;
(g) sanding discs can be packed one on top of each other subsequent to manufacture because there is no glue on them that will allow the discs to stick to one another and there is no need for intermediate wax papers and the like.

The embodiments of the invention in which an exclusive property or privilege is claimed are defined as follows:

1. In combination, a back-up pad for a sanding machine, the back-up pad having a flat surface coated with a feathering adhesive, and an abrasive sheet comprising a paper base sheet, an abrasive bonded to the front surface of the paper sheet and a flexible coating bonded to the rear surface of the paper sheet, the coating providing a smooth rear surface of the abrasive sheet which smooth rear surface is free of adhesive, the combination being such that when the abrasive sheet is secured to the back-up pad the adhesive on the back-up pad, being the sole means for securing the abrasive sheet to the back-up pad, holds the abrasive sheet to the back-up pad for sanding operations, the coating being sufficiently smooth to allow the abrasive sheet to be peeled away from the back-up pad without removing the adhesive from the back-up pad.

2. The combination according to claim 1 wherein the flexible coating bonded to the rear surface of the paper base sheet comprises an ethylene-polyvinyl acetate copolymer.

3. The combination according to claim 1 wherein the flexible coating bonded to the rear surface of the paper base sheet comprises a nylon film.

* * * * *